US010088795B2

(12) United States Patent
Ikeda et al.

(10) Patent No.: US 10,088,795 B2
(45) Date of Patent: Oct. 2, 2018

(54) CLEANING BLADE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Yohei Ikeda, Mishima (JP); Arihiro Yamamoto, Suntou-gun (JP); Tomoya Kawakami, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/729,848

(22) Filed: Oct. 11, 2017

(65) Prior Publication Data

US 2018/0120753 A1 May 3, 2018

(30) Foreign Application Priority Data

Oct. 31, 2016 (JP) ..... 2016-213369

(51) Int. Cl.
*G03G 21/18* (2006.01)
*G03G 21/00* (2006.01)

(52) U.S. Cl.
CPC ..... *G03G 21/0017* (2013.01); *G03G 21/18* (2013.01)

(58) Field of Classification Search
None
See application file for complete search history.

(56) References Cited

U.S. PATENT DOCUMENTS 7,769,337 B2 * 8/2010 Itoh ..... G03G 9/0819 399/350
7,778,585 B2 8/2010 Uchida et al.
8,160,486 B2 4/2012 Inoue et al.
8,594,552 B2 11/2013 Yamamoto et al.
8,594,553 B2 11/2013 Uematsu et al.
8,983,336 B2 3/2015 Kojima et al.
9,817,358 B2 * 11/2017 Abe ..... G03G 21/0017
(Continued)

FOREIGN PATENT DOCUMENTS

JP 2001-075451 A 3/2001
JP 2007-52062 A 3/2007
(Continued)

*Primary Examiner* — Sevan A Aydin
(74) *Attorney, Agent, or Firm* — Fitzpatrick, Cella, Harper & Scinto

(57) ABSTRACT

There is provided a cleaning blade including an elastic member and a supporting member, in which a free end of the elastic member has an edge and a hardened surface constituting the edge. The cleaning blade satisfies a relationship of $0.10 \leq DHs \leq 0.40$ and $DHs \geq DHm$ where DHs ($mN/\mu m^2$) represents a dynamic hardness of the hardened surface and DHm ($mN/\mu m^2$) represents a maximum value of a dynamic hardness obtained in a positional range in which a distance L from the edge on a straight line that bisect an angle of the edge satisfies $0\ \mu m < L \leq 200\ \mu m$ and in AFM-IR spectrum of the hardened surface, peak intensity ν C═O free (1724 to 1736 $cm^{-1}$) derived from a urethane group and peak intensity ν C═O bond (1708 to 1720 $cm^{-1}$) derived from a urethane group hydrogen bond has a specific relationship.

8 Claims, 7 Drawing Sheets

(56) References Cited

U.S. PATENT DOCUMENTS

| | | | | |
|---|---|---|---|---|
| 2017/0212469 | A1 | 7/2017 | Kawakami et al. | |
| 2018/0043398 | A1* | 2/2018 | Osajima | B05C 21/00 |

FOREIGN PATENT DOCUMENTS

| | | | |
|---|---|---|---|
| JP | 2008-256780 | A | 10/2008 |
| JP | 2009-025451 | A | 2/2009 |
| JP | 2009-80167 | A | 4/2009 |

* cited by examiner

CLEANING BLADE, PROCESS CARTRIDGE, AND ELECTROPHOTOGRAPHIC IMAGE FORMING APPARATUS

BACKGROUND OF THE INVENTION

Field of the Invention

The present invention relates to a cleaning blade and a process cartridge used for an electrophotographic image forming apparatus, and an electrophotographic image forming apparatus.

Description of the Related Art

Conventionally, an electrophotographic image forming apparatus (hereinafter, also referred to as "electrophotographic apparatus") is provided with various cleaning members in order to remove a toner remaining on an image bearing member after transferring a toner image onto a transfer body such as a paper or an intermediate transfer body from the image bearing member such as a photosensitive member. A cleaning blade using a plate-like elastic member is well known as a cleaning member, and, in many cases, particularly, the elastic member is made of a polyurethane elastomer.

Further, in recent years, due to the high image quality of an electrophotographic apparatus, there has been a circumstance that the reduction of a toner in diameter and the spherionization of the toner progresses, and the toner remaining on an image bearing member easily passes through a cleaning blade. Therefore, the cleaning blade requires higher cleaning performance. As a method of improving cleaning performance, a method of increasing the contact pressure of the cleaning blade against the image bearing member is known. However, in this method, the frictional force between the image bearing member and the cleaning blade increases, the behavior of the contact portion of the cleaning blade becomes unstable, and thus noise and turnover of the cleaning blade tend to occur.

Therefore, there has been proposed a cleaning blade in which the concentration of an isocyanurate group at the contact portion of the cleaning blade made of a polyurethane elastomer is increased (Japanese Patent Application Laid-Open No. 2001-075451). However, in such a cleaning blade, the flexibility of the contact portion is deteriorated, the followability to unevenness on the surface of the image bearing member is deteriorated due to long-term use, and thus cleaning properties may be deteriorated in some cases.

Japanese Patent Application Laid-Open No. 2009-025451 discloses a cleaning blade in which nitrogen concentration continuously is increased from the inside of the contact portion with a member to be cleaned toward the surface of the contact portion. However, in such a cleaning blade, noise and turnover of the cleaning blade may occur under a low-temperature environment in some cases.

SUMMARY OF THE INVENTION

An aspect of the present invention intends to provide a cleaning blade capable of exhibiting more excellent cleaning performance.

Further, an aspect of the present invention intends to provide a process cartridge and an electrophotographic image forming apparatus which contribute to the stable formation of a high-quality electrophotographic image.

According to an aspect of the present invention, there is provided a cleaning blade, including: an elastic member containing urethane rubber; and a supporting member supporting the elastic member, wherein a free end of the elastic member has an edge and a first plane and a second plane constituting the edge, either or both of the first plane and the second plane have a hardened surface, wherein, the cleaning blade satisfies the following relationships represented by Formula (1) and Formula (2):

$$0.10 \leq DHs \leq 0.40 \quad (1)$$

$$DHs \geq DHm \quad (2)$$

where DHs ($mN/\mu m^2$) represents a dynamic hardness of the hardened surface and DHm represents a maximum value of a dynamic hardness obtained in a positional range in which a distance L from the edge on a straight line that bisects an angle of the edge in a cross-section of the elastic member orthogonal to a longitudinal direction of the elastic member satisfies $0\ \mu m < L \leq 200\ \mu m^2$ wherein, the cleaning member satisfies a peak intensity ratio $I_{bs}/I_{fs}$ of 1.0 or less, wherein $I_{bs}$ represents a peak intensity of ν C═O bond (1708 to 1720 $cm^{-1}$) derived from a urethane group hydrogen bond and $I_{fs}$ is a peak intensity of ν C═O free (1724 to 1736 $cm^{-1}$) derived from a urethane group in urethane rubber in an IR chart obtained at the hardened surface with AFM-IR, and wherein, when M1 is defined as a maximum value of a peak intensity ratio of $I_{b1}/I_{f1}$ in a positional range in which a distance L from the edge on the straight line satisfies $0 < L \leq 200\ \mu m$, where $I_{b1}$ is a peak intensity of ν C═O bond (1708 to 1720 $cm^{-1}$) derived from a urethane group hydrogen bond and $I_{f1}$ is a peak intensity of ν C═O free (1724 to 1736 $cm^{-1}$) derived from a urethane group in urethane rubber in IR charts obtained at each positions in the positional range with AFM-IR, the maximum value $M_1$ is greater than the peak intensity ratio $I_{bs}/I_{fs}$.

According to another aspect of the present invention, there is provided a process cartridge having the cleaning blade. Further, according to another aspect of the present invention, there is provided an electrophotographic image forming apparatus having the cleaning blade.

Further features of the present invention will become apparent from the following description of exemplary embodiments with reference to the attached drawings.

BRIEF DESCRIPTION OF THE DRAWINGS

FIG. 1A shows an example of an integral molding type cleaning blade. FIG. 1B shows an example of an adhesion type cleaning blade.

DESCRIPTION OF THE EMBODIMENTS

Preferred embodiments of the present invention will now be described in detail in accordance with the accompanying drawings.

Examples of a member to be cleaned to which a cleaning blade according to an embodiment of the present invention is applied include an image bearing member such as a photosensitive member and an endless belt such as an intermediate transfer belt. Hereinafter, embodiments of the cleaning blade of the present invention will be described in detail by taking a photosensitive member as the member to be cleaned as an example.

<Configuration of Cleaning Blade>

Figure 1A:
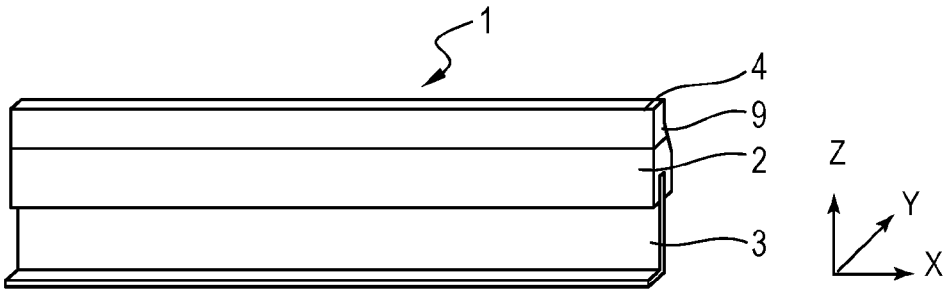
FIGS. 1A and 1B are perspective views of a cleaning blade according to the present invention.
Figure 1B:
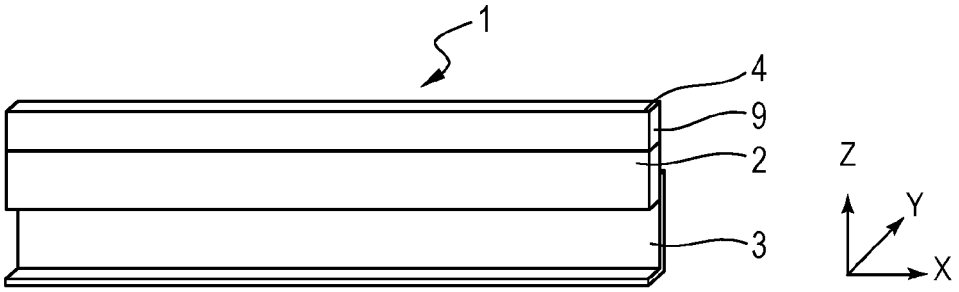

FIGS. 1A, 1B, 2 and 3 show a cleaning blade according to an embodiment of the present invention. FIGS. 1A and 1B are schematic views showing the configuration of a cleaning blade. The cleaning blade includes an elastic member 2 containing urethane rubber and a supporting member 3 supporting the elastic member 2. The elastic member has an edge and first and second planes constituting the edge at the free end portion thereof, and has a hardened surface in which either or both of the first and second planes forming the edge brought into contact with the member to be cleaned comes into contact with the member to be cleaned. That is, from the viewpoint of realizing the improvement of cleaning performance, a cured region is formed on the plane brought into contact with the member to be cleaned and inside the vicinity of its surface in at least one of the first and second planes on both sides of the edge of the cleaning blade brought into contact with the member to be cleaned. In FIGS. 1A and 1B, the "longitudinal direction" of the cleaning blade is X direction, and the "short direction" and "width direction" thereof are Z direction and Y direction, respectively.

In this cleaning blade, the "free end" of the elastic member is an end portion of the elastic member opposite to the end portion supported by the supporting member. The "edge" is a ridge line portion formed by the intersection of the first plane and the second plane in the contact portion of the cleaning blade brought into contact with the member to be cleaned. The "first plane" is, for example, a lower surface 5 or elevation surface 6 of the elastic member in FIG. 2, and the "second plane" is, for example, an elevation surface 6 or lower surface 5 of the elastic member in FIG. 2. Hereinafter, a description will be made with the lower surface 5 as the first plane and the elevation surface 6 as the second plane. The free end of the elastic member and the vicinity thereof may be referred to as the "tip portion" of the elastic member or the "tip portion" of the cleaning blade.

FIG. 1A shows an example of a cleaning blade in which an elastic member 2 and a supporting member 3 are integrally formed. The cleaning blade according to this embodiment can be obtained by disposing a supporting member in a mold, injecting a raw material composition such as polyurethane elastomer into the mold, heating the mold to react and cure the composition, and then demolding the cured and reacted composition. After the demolding, if necessary, it is possible to cut the tip portion of the free end of the elastic member in the Z direction and both end portions of the elastic member in the X direction. The time for forming the cured region at the tip portion of the elastic member may be before or after cutting. Thus, it is possible to obtain a cleaning blade in which the elastic member 2 containing urethane rubber and the supporting member 3 are integrated with each other.

FIG. 1B shows an example of an adhesion type cleaning blade obtained by separately molding a sheet for an elastic member, cutting the sheet in the shape of a strip to make the elastic member 2 and attaching this elastic member 2 to the supporting member 3 by an adhesive. The time for forming the cured region 4 at the tip portion of the elastic member may be before or after attaching the elastic member to the supporting member.

[Supporting Member]

Figure 2:
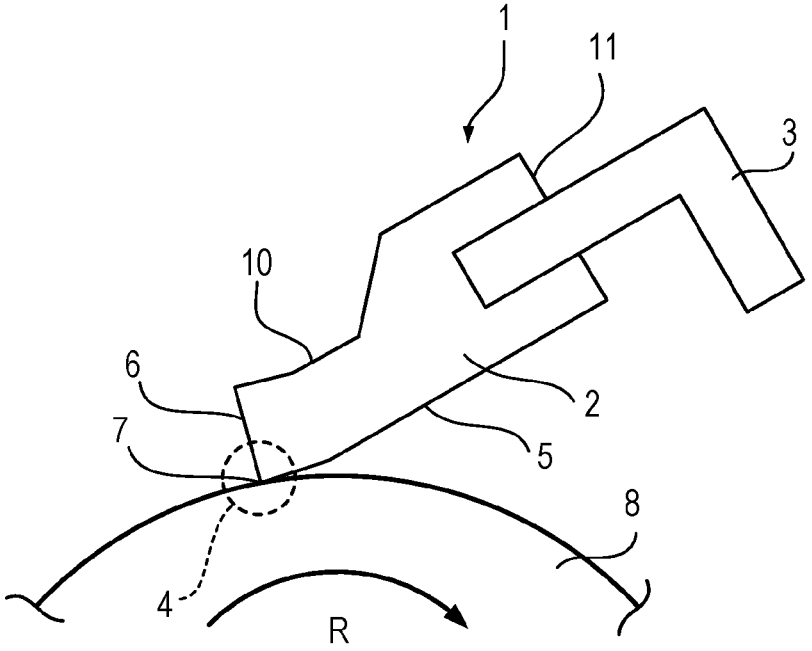
FIG. 2 is a view showing a state in which the edge of a cleaning blade comes into contact with a member to be cleaned at the time of stopping a process cartridge. The longitudinal direction (X direction) of an elastic member is a direction perpendicular to paper plane of this drawing.

The material constituting the supporting member is not particularly limited, and for example, the following materials can be mentioned. Examples thereof include metal materials such as a steel sheet, a stainless steel sheet, a zinc-coated steel sheet, and a chromium-free steel sheet, and resin materials such as 6-nylon and 6,6-nylon. The structure of the supporting member is also not particularly limited. As shown in FIG. 2 and the like, one end of the elastic member of the cleaning blade is supported by the supporting member.

[Elastic Member]

The elastic member containing urethane rubber may contain urethane rubber, and may further contain other materials. Examples of other materials include the following materials. Examples thereof include ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, an epichlorohydrin rubber, hydrogenated products of NBR, and polysulfide rubber.

From the viewpoint of mechanical properties being excellent, the urethane rubber (polyurethane elastomer) is preferably a polyester urethane elastomer. The polyurethane elastomer is a material mainly obtained from raw materials such as polyisocyanate, polyol, a chain extender, a catalyst, and other additives. Hereinafter, these materials will be described in detail.

Examples of the polyisocyanate are as follows. Examples thereof include 4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylene phenyl polyisocyanate (PAPI). Among these, from the viewpoint of obtaining a polyurethane elastomer having excellent mechanical properties, MDI is preferable.

Examples of the polyol are as follows. Examples thereof include polyester polyols such as polyethylene adipate polyol, polybutylene adipate polyol, polyhexylene adipate polyol, (polyethylene/polypropylene) adipate polyol, (polyethylene/polybutylene) adipate polyol, and (polyethylene/polyneopentylene) adipate polyol; polycaprolactone-based polyols obtained by the ring-opening polymerization of caprolactone; polyether polyols such as polyethylene glycol, polypropylene glycol, and polytetramethylene glycol; and polycarbonate diols. These polyols can be used alone or in combination of two or more. Among the above polyols, from the viewpoint of obtaining a polyurethane elastomer having excellent mechanical properties, polyester polyols are preferable.

As the chain extender, from the viewpoint of extending a polyurethane chain, for example, glycols can be used. Examples of such glycols can be exemplified as follows. Examples thereof include ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. In addition to the above glycols, other polyhydric alcohols can also be used, and examples thereof can include trimethylolpropane, glycerin, pentaerythritol, and sorbitol. These can be used alone or in combination of two or more.

As the above catalyst, a commonly used catalyst for curing polyurethane elastomer can be used, and examples thereof include tertiary amine catalysts. Specific examples thereof are as follows. Specific examples thereof include amino alcohols such as dimethylethanolamine and N,N,N'-trimethylaminopropylethanolamine; trialkylamine such as triethylamine; tetraalkyldiamine such as N,N,N'N'-tetramethyl-1,3-butanediamine; triethylene diamine; piperazine-based compounds; and triazine-based compounds. In addition, organic acid salts of metal such as potassium acetate and potassium alkali octylate can also be used. Furthermore, a metal catalyst used for urethanization, for example, dibutyltin dilaurate, can also be used. These catalysts can be used alone or in combination of two or more.

Additives such as a pigment, a plasticizer, a waterproof agent, an antioxidant, an ultraviolet absorber, and a light stabilizer may be added to these raw material compositions as necessary.

In the elastic member, the angle of the edge formed by the first plane and the second plane is not particularly limited, but is generally about 85° to 95°.

[Material for Forming Cured Region]

The material for forming a cured region is not particularly limited as long as it can cure the elastic member or can form a cured region on the surface of the elastic member, and examples thereof include isocyanate compounds and acrylic resins. The material for forming the cured region may be diluted with a solvent or the like and then used. The solvent used for dilution is not particularly limited as long as it dissolves the material used, and examples thereof include toluene, xylene, butyl acetate, methyl isobutyl ketone, and methyl ethyl ketone.

When the constituent material of the elastic member is a polyester urethane elastomer, as the material for forming the cured region, considering compatibility with the elastic member and impregnation into the elastic member, it is preferable to use an isocyanate compound, which is a constituent material of the polyester urethane elastomer. As the isocyanate compound to be brought into contact with the elastic member, an isocyanate compound having at least one isocyanate group in the molecule can be used. As the isocyanate compound having one isocyanate group in the molecule, an aliphatic monoisocyanate such as octadecyl isocyanate (ODI), an aromatic monoisocyanate such as phenyl isocyanate (PHI), or the like can be used. As the isocyanate compound having two isocyanate groups in the molecule, those commonly used for the production of polyurethane resin can be used, and specific examples thereof can be as follows. Specific examples thereof include 2,4-tolylene diisocyanate (2,4-TDI), 2,6-tolylene diisocyanate (2,6-TDI), 4,4'-diphenylmethane diisocyanate (MDI), m-phenylene diisocyanate (MPDI), tetramethylene diisocyanate (TMDI), hexamethylene diisocyanate (HDI), and isophorone diisocyanate (IPDI). As the isocyanate compound having three or more isocyanate groups in the molecule, for example, 4,4',4"-triphenylmethane triisocyanate, 2,4,4'-biphenyl triisocyanate, and 2,4,4'-diphenylmethane triisocyanate can be used. Further, as the isocyanate compound having two or more isocyanate groups, modified derivatives, multimers, and the like thereof can also be used. Among them, in order to efficiently increase the hardness of the cured region, MDI having high crystallinity, that is, having a symmetrical structure is preferable. Further, MDI containing a modified product is more preferable in terms of workability because it is liquid at room temperature.

In the cured region formed by these materials, generally, a portion where the elastic member is impregnated with isocyanate and is cured and a portion where the isocyanate and the like are cured on the surface of the elastic member coexist.

[Hardness of Cured Region]

In the cured region in the vicinity of the free end of the elastic member, the dynamic hardness of the surface of the first plane and/or the second plane is equal to or greater than the dynamic hardness of inner part. The contact surface of the elastic member brought into contact with the member to be cleaned needs to be flexible from the viewpoint of stably ensuring the state of contact with the member to be cleaned. Therefore, the hardened surface has a dynamic hardness DHs of 0.10 $mN/\mu m^2$ or more and 0.40 $mN/\mu m^2$ or less. DHs is preferably 0.15 $mN/\mu m^2$ or more and 0.35 $mN/\mu m^2$ or less. When the dynamic hardness DHs of the hardened surface is more than 0.40 $mN/\mu m^2$, the hardness of the surface is too large, and edge chipping may occur in some cases. Further, when the dynamic hardness DHs of the hardened surface is less than 0.10 $mN/\mu m^2$, even if the hardness of inner part in the vicinity of the surface becomes large, the contact width becomes too wide, the peak pressure decreases, and thus the cleaning performance may deteriorate. Here, the peak pressure means the maximum value of the contact pressure per unit area of the contact portion.

The measurement portion of dynamic hardness of inner part of the elastic member is each position where the distance L from the edge on a bisector of the edge angle consisting of a first plane and a second plane in the section orthogonal to the longitudinal direction of the elastic member is $0\ \mu m<L\leq 200\ \mu m$. When the maximum value of dynamic hardness (hereinafter, also referred to as "dynamic hardness of inner part") in each position is represented as DHm ($mN/\mu m^2$), the DHs is equal to or greater than DHm. Here, DHm ($mN\mu m^2$) may also defined as a maximum value of a dynamic hardness obtained in a positional range in which a distance L from the edge on a straight line that bisects an angle of the edge in a cross-section of the elastic member orthogonal to a longitudinal direction of the elastic member satisfies $0\ \mu m<L\leq 200\ \mu m$.

DHs and DHm satisfies a relationship represented by Equations (1) and (2). Since the cleaning blade has such a configuration, the cleaning blade has improved followability with the member to be cleaned in a low-temperature environment. Since rubber elasticity decreases in the low-temperature environment, when the cleaning blade has a wide cured region in which the hardness increases from the surface thereof toward the inside thereof, the followability with the member to be cleaned also decreases, and toner slipping easily occurs. Further, when the maximum value of dynamic hardness does not exist at the position where the distance L is within a range of $0\ \mu m<L\leq 200\ \mu m$ and there is a portion with dynamic hardness higher than DHs at the position where the distance L exceeds 200 μm, at the time of bringing the cleaning blade into contact with the member to be cleaned, the contact width is excessively widened, and the peak pressure many not be increased in some cases, and toner slipping easily occurs. Thus, when the portion where the distance L is 200 μm or less is set as the hardened region, the deterioration of rubber elasticity in a low-temperature environment can be suppressed, and the cleaning performance can be maintained even in the low-temperature environment.

[Method of Measuring Hardness of Cured Region]

The hardness of the cured region can be measured by the following method. As a measuring machine, "Shimadzu dynamic ultra-microhardness tester DUH-W211S" manufactured by Shimadzu Corporation can be used. As an indenter, a 115° triangular pyramid indenter can be used, and the dynamic hardness can be obtained from the following calculation formula.

Dynamic hardness: $DH=\alpha\times P/D^2$

In the formula, α represents an integer depending on an indenter shape, P represents testability (mN), and D represents the penetration amount (indentation depth) (μm) into a sample of the indenter.

Measurement conditions are as follows.

α: 3.8584,

P: 1.0 mN,

Load speed: 0.03 mN/sec,

Holding time: 5 seconds,

Measurement environment: temperature 23° C. and relative humidity 55%,

Aging of measurement sample: Leaving the sample for 6 hours or more in an environment with a temperature of 23° C. and a relative humidity of 55%.

Figure 5:
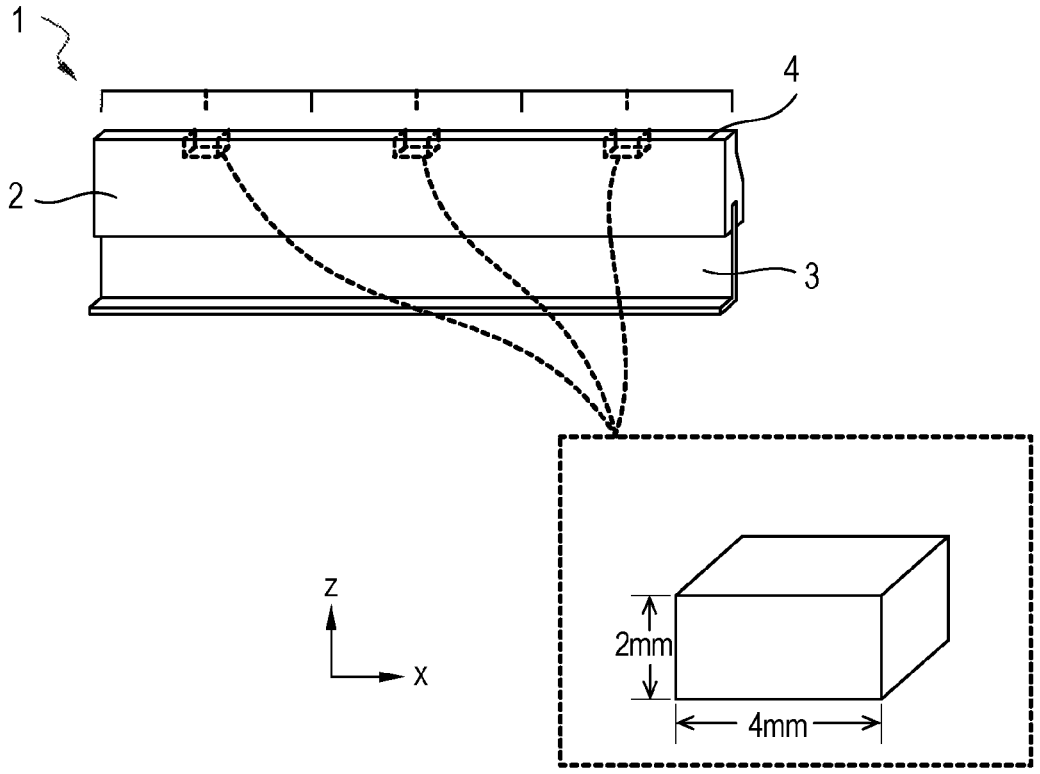
FIG. 5 is a view showing a cutout portion of a measurement sample.

The method for preparing the measurement sample is as follows. The measurement sample is cut in a dimension of 4 mm (2 mm in both directions from middle point) in a longitudinal direction from each of the middle points (three places) of three places obtained by trisecting the longitudinal direction in the image forming region and 2 mm in a short direction from the edge (refer to FIG. 5).

Figure 6A:
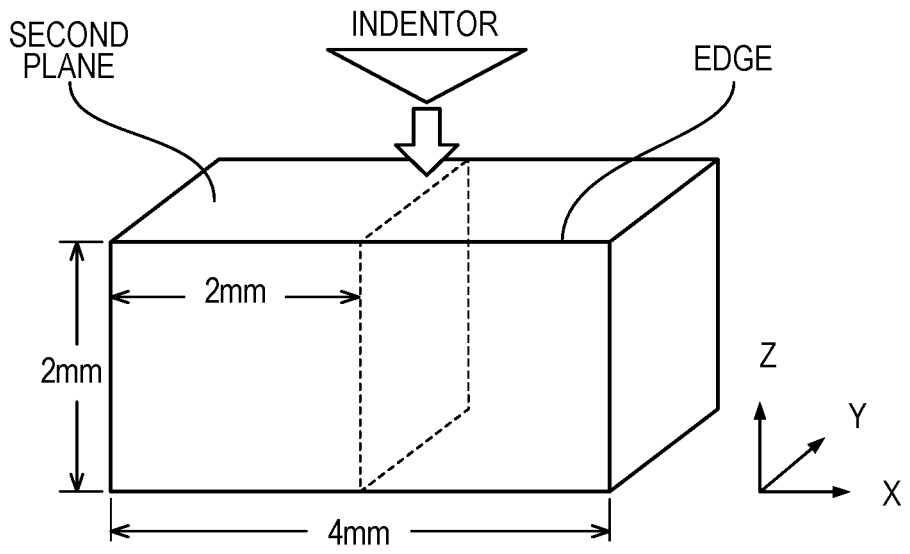
FIG. 6A is a measurement view of dynamic hardness of a hardened surface.

In the measurement of the dynamic hardness DHs of the hardened surface, a sample is disposed such that the indenter vertically meets the hardened surface (first plane, second plane) of the cured region of the measurement sample, the dynamic hardness DHs thereof is measured at a position detached from the end by 2 mm in the longitudinal direction and at a position detached from the edge by 100 μm or more and 500 μm or less in the short direction or thickness direction. FIG. 6A is a view in which the indenter is disposed to vertically meet the second plane of the sample. This measurement is performed on three measurement samples, and the average value thereof is represented as the dynamic hardness $DHs_2$ of the surface of the second plane. Similarly, the indenter is disposed to vertically meet the first plane of three measurement samples, and the average value of three measurement values is represented as the dynamic hardness $DHs_1$ of the surface of the first plane. Further, from the dynamic hardness $DHs_1$ of the surface of the first plane and the dynamic hardness $DHs_2$ of the surface of the second plane, higher value is represented as dynamic hardness of DHs ($mN/\mu m^2$) of the hardened surface.

Figure 6B:
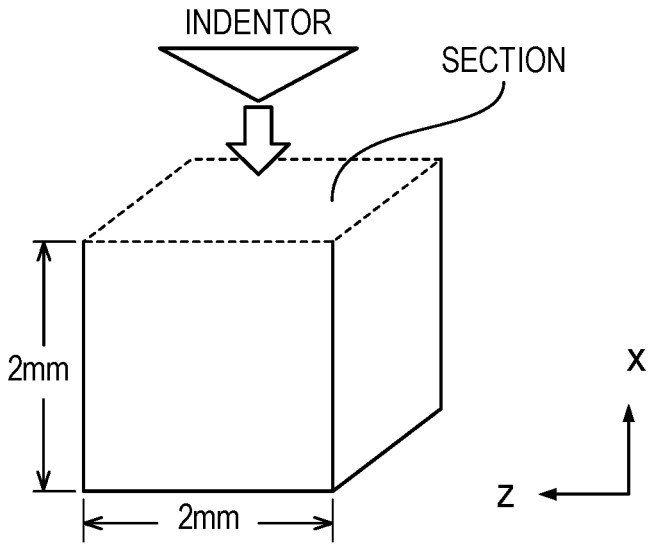
FIG. 6B is a measurement view of dynamic hardness of a cross-section orthogonal to the longitudinal direction of an elastic member.
Figure 7:
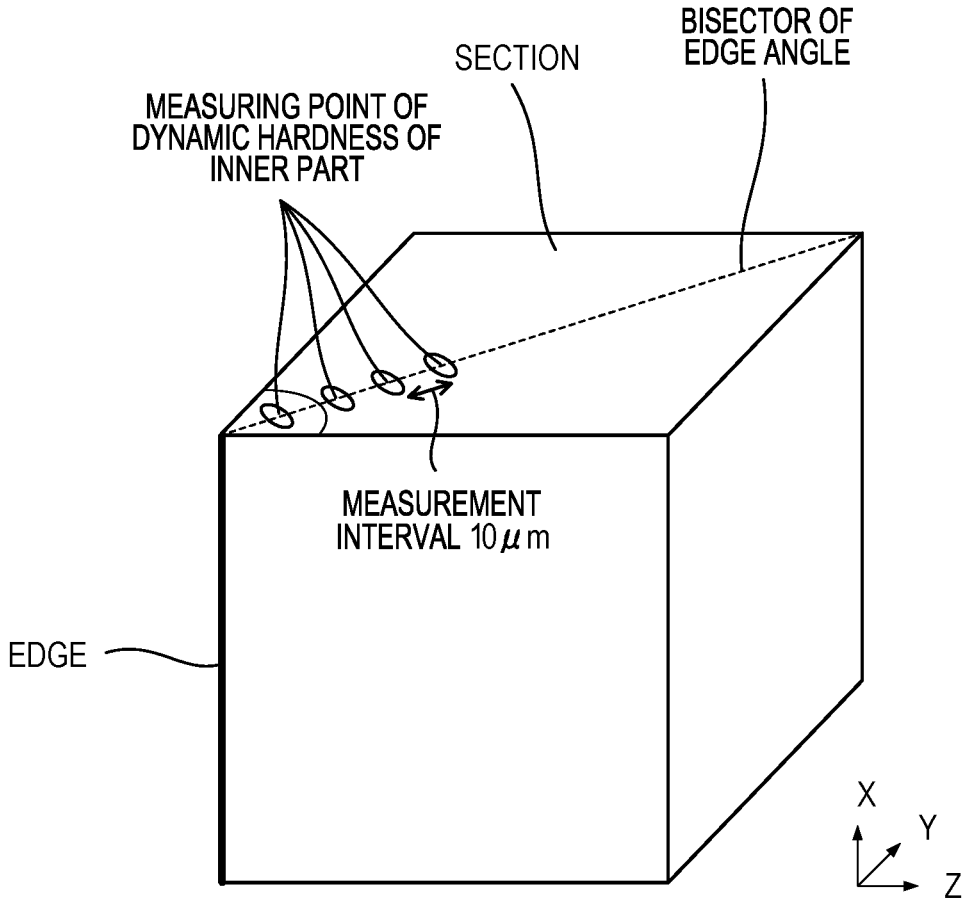
FIG. 7 is a view showing the measuring points of dynamic hardness in a cross-section orthogonal to the longitudinal direction of an elastic member.

The "dynamic hardness of inner part" is measured by the following method. Each sample after the measurement on the hardened surface is cut at a position of 2 mm in the longitudinal direction, and the sample is disposed such that the indenter vertically meets the cut surface (Refer to FIG. 6B). The measurement position is a position at which the distance from the edge on the bisector of the edge angle is 10 μm. Measurements are sequentially performed at these respective positions, and the measurement values are measured up to the point where the dynamic hardness of the elastic member on which the cured region is not formed (FIG. 7). This measurement is performed with respect to three measurement samples, and the average value thereof is defined as the dynamic hardness inner part of the free end. Further, the maximum value of these measurement values of dynamic hardness is represented as DHm ($mN/\mu m^2$).

[Urethane Group Hydrogen Bonding of Cured Region]

The peak intensity ratio $I_{bs}/I_{fs}$ of peak intensity $I_{bs}$ of ν C═O bond (1708 to 1720 $cm^{-1}$) derived from urethane group hydrogen bonding at 1708 to 1720 $cm^{-1}$ to peak intensity $I_{fs}$ of ν C═O free (1724 to 1736 $cm^{-1}$) derived from a urethane group in urethane rubber at 1724 to 1736 $cm^{-1}$ in the AFM-IR spectrum of the hardened surface is 1.0 or less.

The urethane group hydrogen bonding is bonding formed by packing a hard segment derived from a urethane group (urethane bond moiety) of a urethane resin. The amount of this urethane group hydrogen bonding is measured as a C═O extendable peak appearing at 1708 to 1720 $cm^{-1}$ in the AFM-IR spectrum.

When the packing of the hard segment weakens, ν C═O bond (1708 to 1720 $cm^{-1}$) is observed as a shoulder, not a peak, in the spectrum. Further, when the packing of the hard segment is insufficient, no peak derived from urethane group hydrogen bond is observed in this spectrum.

When the urethane bonds are spatially close to each other, hard segments agglomerate due to the interaction derived from hydrogen bonds, so that the degree of microphase separation of hard segment and soft segment tends to be larger. When the hard segments highly agglomerate, crystallinity is developed and the glass transition point (Tg) of the urethane rubber increases. When the peak intensity ratio $I_{bs}/I_{fs}$ of the hardened surface is greater than 1.0, the glass transition point (Tg) shifts toward higher temperature, so that the rubber responsiveness of the contact portion of the member to be cleaned in the low-temperature region increases, and noise (squeal) of the cleaning blade occurs during the long-term use of the electrophotographic image forming apparatus. When the cleaning blade is used for a while with noise, the tip of the cleaning blade sometimes turns to the downstream side. Thus, the peak intensity ratio $I_{bs}/I_{fs}$ on the hardened surface is required to be 1.0 or less, and preferably 0.85 or less. The lower limit value of the peak intensity ratio $I_{bs}/I_{fs}$ on the hardened surface is not particularly limited, but is preferably 0.65 or more, and more preferably 0.75 or more.

The peak intensity ratio in the elastic member having the cured region formed on its surface and the measurement position thereof are as follows. The measurement position, similarly to the measurement position of the "dynamic hardness of inner part", is each position where the distance L from the edge on a bisector of the edge angle consisting of a first plane and a second plane in the section orthogonal to the longitudinal direction of the elastic member is 0 μm<L≤200 μm.

In this position, the maximum value of the peak intensity ratios $I_{b1}/I_{f1}$ (hereinafter, referred to as "peak intensity ratio of inner part 1) of peak intensity $I_{b1}$ of ν C═O bond (1708 to 1720 $cm^{-1}$) derived from a urethane group hydrogen bond at 1708 to 1720 $cm^{-1}$ to peak intensity $I_{f1}$ of ν C═O free (1724 to 1736 $cm^{-1}$) derived from a urethane group in urethane rubber at 1724 to 1736 $cm^{-1}$ in the AFM-IR spectrum is represented by $M_1$. That is, M1 is defined as a maximum value of a peak intensity ratio of $I_{b1}/I_{f1}$ in a positional range in which a distance L from the edge on the straight line satisfies 0 μm<L≤200 μm, where $I_{b1}$ is a peak intensity of ν C═O bond (1708 to 1720 $cm^{-1}$) derived from a urethane group hydrogen bond and $I_{f1}$ is a peak intensity of ν C═O free (1724 to 1736 $cm^{-1}$) derived from a urethane group in urethane rubber in IR charts obtained at each positons in the positional range with AFM-IR.

The maximum value $M_1$ of the peak intensity ratio of inner part 1 is greater than the peak intensity ratio $I_{bs}/I_{fs}$ of the hardened surface, so that the cleaning properties in a low temperature environment are improved.

That is, since the maximum value $M_1$ of the peak intensity ratio of inner part 1 is greater than the peak intensity ratio of the hardened surface, the contact pressure required at the time of bringing the cleaning blade into contact with the member to be cleaned is secured, and thus it is difficult to decrease the peak pressure even if the area of the contact portion becomes somewhat larger. As a result, the cleaning blade exhibits excellent cleaning performance.

In the position indicating the maximum value $M_1$, the distance L from the edge on the straight line is preferably in a range of 20 μm or more and 100 μm or less, and more preferably in a range of 20 μm or more and 50 μm or less.

The maximum value $M_1$ is preferably 1.10 times or more the peak intensity ratio $I_{bs}/I_{fs}$, and more preferably 1.15 times or more the peak intensity ratio $I_{bs}/I_{fs}$. That is, the amount of hydrogen bonding derived from a urethane group of the inner part is preferably 1.10 times or more the amount of hydrogen bonding derived from a urethane group of the hardened surface, and more preferably 1.15 times or more the amount of hydrogen bonding derived from a urethane group of the hardened surface. When the amount of hydrogen bonding derived from a urethane group of the inner part is preferably 1.10 times or more the amount of hydrogen bonding derived from a urethane group of the hardened surface, it is possible to more reliably apply the contact pressure to the member to be cleaned.

At a position where the distance L exceeds 200 μm, when there is a portion showing a peak intensity ratio having a value larger than the value of M1, the contact width is excessively widened at the time of bringing the cleaning blade into contact with the member to be cleaned, peak pressure may not increase in some cases, and cleaning performance deteriorates during long-term use in low temperature environment. Therefore, at the position where the distance L from the edge on the straight line exceeds 200 μm, when the maximum value of the peak intensity ratio $I_{b2}/I_{f2}$ (hereinafter, referred to as "peak intensity ratio of inner part 2) of peak intensity $I_{b2}$ of ν C═O bond (1708 to 1720 $cm^{-1}$) derived from a urethane group hydrogen bond to peak intensity $I_{f2}$ of ν C═O free (1724 to 1736 $cm^{-1}$) derived from a urethane group in urethane rubber is defined by $M_2$, the maximum value $M_1$ is preferably 1.10 times or more, and more preferably 1.15 times or more the maximum value $M_2$. It is possible to more effectively suppress the turnover of the cleaning blade during long-term use in a low temperature environment by setting the relationship between M1 and M2 as described above.

Figure 3:
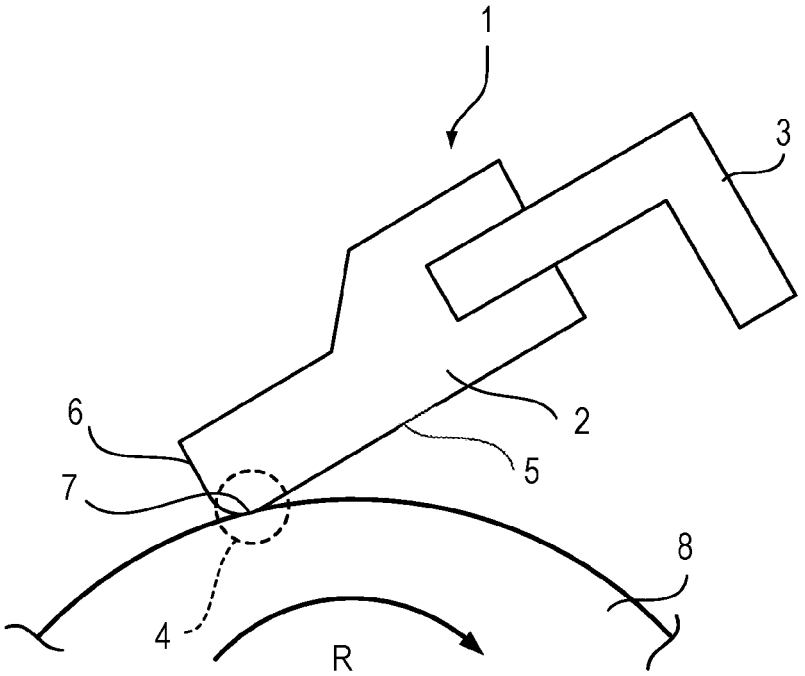
FIG. 3 is a view showing a state in which a cleaning blade comes into contact with a member to be cleaned at the time of operating a process cartridge.
Figure 4:
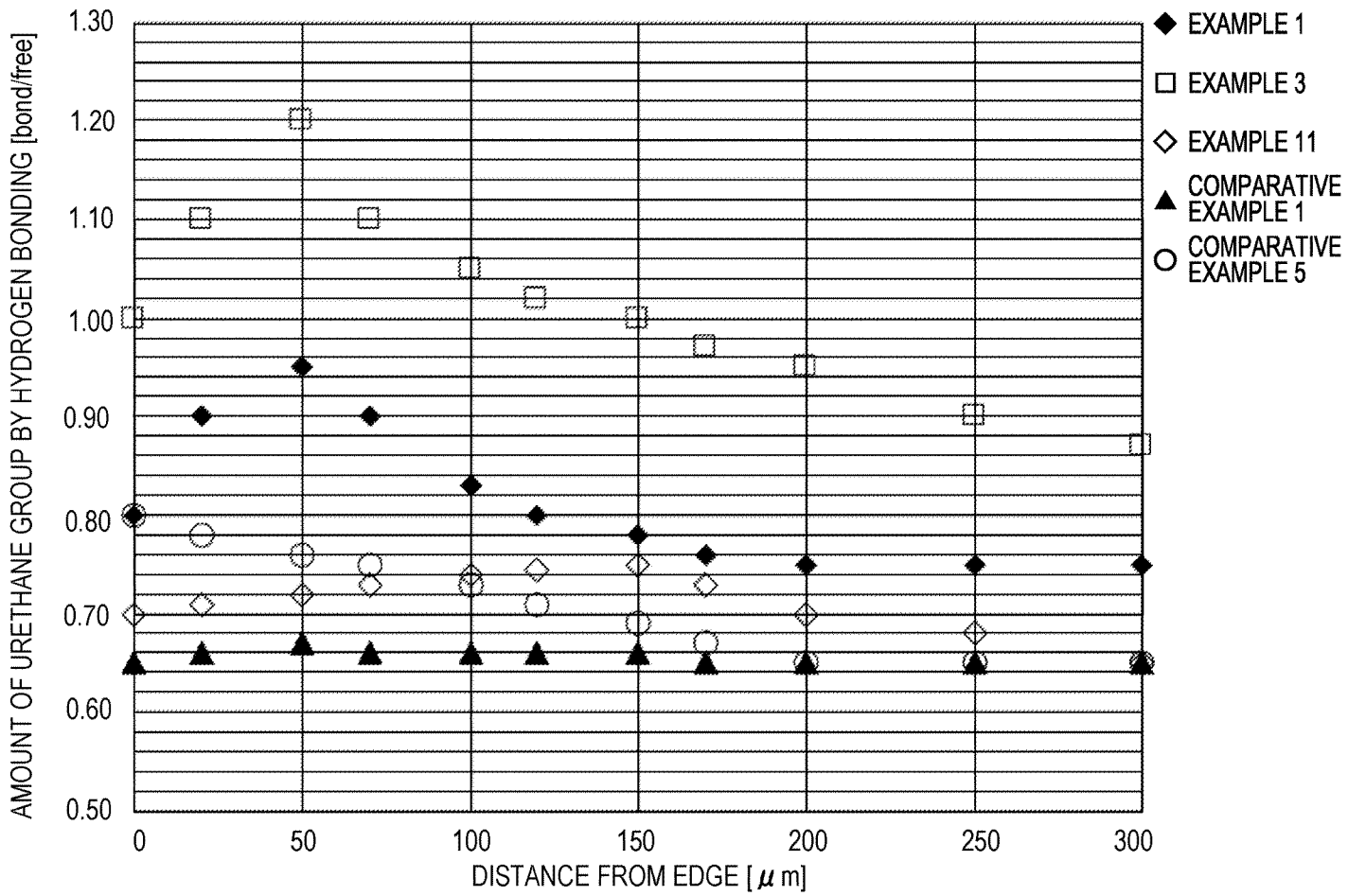
FIG. 4 is a view showing an amount of hydrogen bonding derived from a urethane group of a hardened surface and inner part of an elastic member in Examples 1, 3 and 11 and Comparative Examples 1 and 5.

It is further preferable that the cured region is formed on both sides of the first plane and the second plane that form the edge to be brought into contact with the member to be cleaned of the elastic member. As shown in FIG. 3, at the time of cleaning, both sides of the first plane and the second plane of the cleaning blade may come into contact with the member to be cleaned in some cases.

[Measurement of the Amount of Hydrogen Bonding Derived from a Urethane Group in Cured Region]

The amount of hydrogen bonding derived from a urethane group in the cured region in the vicinity of the free end of the elastic member can be measured by AFM-IR. AFM-IR measurement can be carried out using nano IR manufactured by Anasys Instruments Corporation.

AFM-IR is an analytical technique of irradiating a sample with infrared rays in pulses and capturing the thermal expansion and shrinkage of the sample due to infrared absorption as vibration of the probe of the scanning probe microscope. In the AFM-IR, the amount of vibration mode causing absorption is detected as the magnitude of vibration of the probe.

An infrared spectroscopic spectrum can be obtained at an arbitrary point in the sample plane by sweeping the wave number of infrared ray to be applied. Further, the distribution of a composition including the vibration mode of a specific wavelength can be visualized by fixing the wavelength of infrared ray to be applied and scanning the inside of the sample with the infrared ray. The wave number range to be measured is 1000 to 1800 $cm^{-1}$.

In the obtained IR spectrum, the maximum peak intensity at 1724 to 1736 $cm^{-1}$ is represented as $I_f$ (free), the maximum peak intensity at 1708 to 1720 $cm^{-1}$ is represented as $I_b$ (bond), and the peak intensity ratio $I_b/I_f$ is defined as the "amount of hydrogen bonding derived from a urethane group" of C═O extendable peak. However, when the IR spectrum is observed as a shoulder having no peak at 1710 to 1720 $cm^{-1}$, the value of 1716 $cm^{-1}$ is used as $I_b$ (bond).

By this definition, the value of the peak intensity ratio $I_{bs}/I_{fs}$ is the "amount of hydrogen bonding derived from a urethane group of the surface", the value of the peak intensity ratio $I_{b1}/I_{f1}$ is the "amount of hydrogen bonding derived from a urethane group of inner part 1", and the value of the peak intensity ratio $I_{b2}/I_{f2}$ is the "amount of hydrogen bonding derived from a urethane group of inner part 2". The "inner part 1" is a position where the distance L is 0 μm<L≤200 μm, and the "inner part 2" is a position where the distance L is 200 μm<L.

The method for preparing the measurement sample is as follows. The measurement sample is cut in a dimension of 4 mm (2 mm in both directions from middle point) in a longitudinal direction from each of the middle points (three places) of three places obtained by trisecting the longitudinal direction in the image forming region and 2 mm in a short direction from the edge 7 (refer to FIG. 5). The cut small piece (hereinafter, referred to as "sample for cutting") is fixed to a fixing jig for microtome. The sample for cutting is installed in a cryomicrotome (FC6, manufactured by Lica Corporation), the temperature of the sample for cutting and the temperature of a knife are set at −50° C., and sections having a thickness of 350 nm to 1 μm including the edge, the first plane, and the second plane are cut. The sections are installed in an AFM-IR prism to perform AFM-IR.

The installation of the section is carried out in the following procedure. First, the prism for AFM-IR is provided in the cryomicrotome and cooled, ethanol droplets are attached onto the prism for AFM-IR, and the section is put into the droplet. Then, excess ethanol is sucked, the prism for AFM-IR is taken out from the cryomicrotome to such a degree that a part of the section comes out of ethanol, and ethanol is removed by a blower before ethanol volatilizes.

Figure 8A:
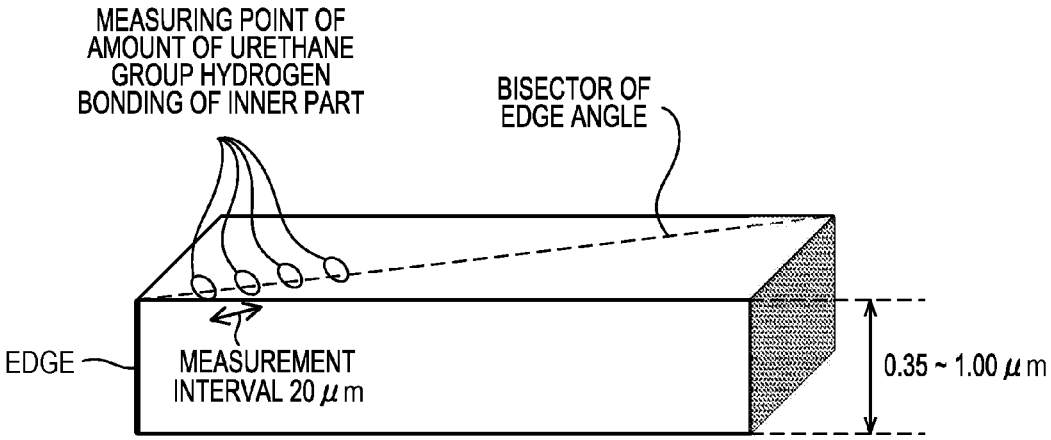
FIGS. 8A and 8B are views showing the measuring points of an amount of hydrogen bonding derived from a urethane group.
Figure 8B:
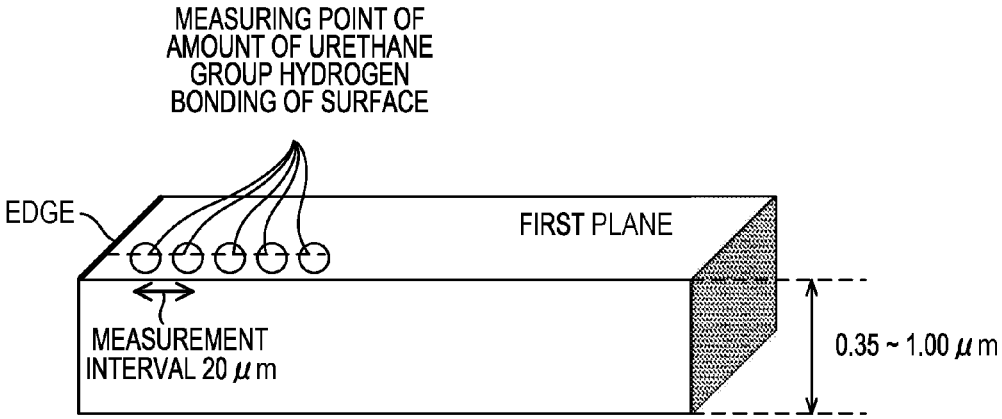

The measurement position on the hardened surface is in a range of 20 μm to 100 μm distance from the edge of the hardened surface (first plane, second plane) of the cured region of the measurement sample in the short direction or thickness direction, and comprises five places where the distance from the edge is set as an interval of 20 μm (refer to FIG. 8B). The average value of the measured values (peak intensity ratio $I_{bs}/I_{fs}$) of three places obtained by trisecting the longitudinal direction is obtained, and the obtained average value is defined as the amount of hydrogen bonding derived from a urethane group of the surface. When the hardened surface is both the first plane and the second plane, the amount of hydrogen bonding derived from a urethane group of the first plane is defined as the amount of hydrogen bonding derived from a urethane group of the surface.

The amount of hydrogen bonding derived from a urethane group of inner part is measured at intervals of 20 μm at each position up to the position where the distance L from the edge on the bisector of the edge angle is 300 μm (refer to FIG. 8A). Even in this case, the average value of the measured values (peak intensity ratio $I_{b1}/I_{f1}$ of inner part 1 or peak intensity ratio $I_{b2}/I_{f2}$ of inner part 2) of three places obtained by trisecting the longitudinal direction is obtained, and the obtained average value is defined as the amount of hydrogen bonding derived from a urethane group of inner part (the amount of hydrogen bonding derived from a urethane group of inner part 1 or the amount of hydrogen bonding derived from a urethane group of inner part 2).

[Method for Manufacturing Cleaning Blade]

[Preparation of Cleaning Blade Precursor]

The method of manufacturing the cleaning blade may be suitably selected from known methods, and is not particularly limited. Further, the method of manufacturing the elastic member may be suitably selected from known methods such as a mold molding method and a centrifugal molding method. For example, a supporting member coated with an adhesive at a contact portion with the elastic member is disposed in a mold for a cleaning blade having a cavity for forming the elastic member. Meanwhile, a prepolymer obtained by partially polymerizing polyisocyanate and polyol and a curing agent containing a polyol, a chain extender, a catalyst and other additives are charged into a casting machine, and mixed and stirred in a mixing chamber at a predetermined ratio, so as to a raw material composition such as a polyurethane elastomer. This raw material composition is injected into the mold to form a cured molded product (elastic member) on the adhesive coated surface of the supporting member, and the cured molded product is released from the mold after reaction curing. If necessary, it is possible to prepare a cleaning blade precursor integrally formed with the supporting member and the elastic member by appropriately cutting the elastic member in order to ensure a predetermined size and edge dimensional accuracy of the contact portion of the elastic member.

Further, when the elastic member is manufactured by a centrifugal molding machine, the raw material composition such as a polyurethane elastomer, obtained by mixing and stirring a prepolymer obtained by partially polymerizing polyisocyanate and polyol and a curing agent containing a polyol, a chain extender, a catalyst and other additives is put into a rotating drum, so as to obtain a polyurethane elastomer sheet. This polyurethane elastomer sheet is cut in order to secure a predetermined dimension and edge dimensional accuracy of the contact portion of the elastic member. The polyurethane elastomer sheet (elastic member) obtained in this way can be attached to a supporting member coated with an adhesive, so as to prepare a cleaning blade precursor.

[Formation of Cured Region]

Next, the formation of the cured region in the elastic member of the cleaning blade precursor can be performed by applying a material for forming the cured region to a region where high hardness is desired and curing the material. The material for forming the cured region can be diluted with a diluting solvent if necessary, and can be applied by known units such as dipping, spraying, dispensing, brush coating, roller coating, and the like.

In order to increase the amount of hydrogen bonding derived from a urethane group, it is preferable that an unreacted isocyanate group is present in the elastic member at the time of forming the cured region. Since the presence of the unreacted isocyanate group is a state in which the crystallization of urethane is not completed, the isocyanate compound, which is a material for forming the cured region, easily reacts with a hydroxyl group present in the elastic member, and thus urethane bonds increase, thereby increasing the amount of hydrogen bonding derived from a urethane group. Further, since the isocyanate compound easily reacts with the hydroxyl group present in the elastic member, as the material for forming the cured region, it is required to adjust the mixing ratio of a prepolymer and a curing agent. As a specific compounding ratio, it is preferable to mix the prepolymer and the curing agent such that the molar ratio (a value) of a hydroxyl group to an isocyanate group is 0.40 or more. When the molar ratio is less than 0.40, the amount of hydrogen bonding derived from a urethane group does not increase because the number of hydroxyl groups in the elastic member is small.

Further, even in the mixing ratio, since the amount of residual isocyanate tends to be gradually inactivated with the lapse of time, it is preferable that the formation of the cured region is performed within 3 hours after manufacturing the elastic member.

The amount of residual isocyanate in the elastic member can be controlled by the mixing ratio and the elapsed time from molding of the elastic member. Regarding the measurement of the amount of residual isocyanate on the surface, for example, the amount of residual isocyanate can be measured by infrared absorption spectroscopy (IR). NCO peak (near 2260 $cm^{-1}$ to 2270 $cm^{-1}$) of isocyanurate and aromatic ring peak (near 1600 $cm^{-1}$) of isocyanate are obtained from the obtained IR spectrum, and the absorbance ratio A/B of absorbance A of NCO and absorbance B of an aromatic ring is defined as "amount of residual isocyanate". In order to increase the amount of hydrogen bonding derived from a urethane group inside the elastic member rather than the surface of the elastic member, the amount of residual isocyanate is preferably 0.5 or more in the measurement on the surface of the elastic member.

In order to increase the amount of hydrogen bonding derived from a urethane group inside the elastic member rather than the surface of the elastic member, it is required to impregnate an elastic body with the material for forming the cured region to some extent. Impregnation is accelerated by making the material for forming the cured region high in concentration and low in viscosity, so it is effective to heat the material for forming the cured region. As the heating condition, the temperature of the material for forming the cured region is preferably 60° C. or higher and 80° C. or lower. When the elastic member is impregnated with the material for forming the cured region at a temperature of higher than 80° C., a high-hardness region exists in the inside rather than on the surface. Further, when the elastic body is impregnated with the material for forming the cured region at a temperature of lower than 60° C., it takes time, and productivity efficiency deteriorates.

In order to allow the region of higher hardness to exist in the inside rather than on the surface and to increase the amount of hydrogen bonding derived from a urethane group of inner part, it is required to perform heat treatment after applying the material for forming the cured region. As a heating method, a method of allowing a precursor to pass through a heating furnace, a method of blowing hot air to a precursor, and the like are exemplified, but the present invention is not particularly limited thereto. For example, as the heating furnace, a radiation type heating furnace, a circulating air type heating furnace, and the like are exemplified. As a device for forming hot air, a hot air heater, a far infrared heater, and the like are exemplified. Due to the heat treatment, the viscosity of an isocyanate compound, which is the material for forming the cured region, existing in the elastic member decreases, and diffusion proceeds. Thus, by setting the heating condition after the treatment at a high temperature or for a long time, the cured region becomes wide, and the region having the highest hardness also changes from the surface to the inside. As the heating condition, it is preferable to heat at least the tip portion of the blade at a temperature of 90° C. to 110° C. for 10 minutes or more and 30 minutes or less. Due to the heating in this temperature range, it is possible to suppress the formation of nurate bonds and allophanate bonds due to the diffusion of the isocyanate compound in the elastic member and to effectively prevent the inner hardness from becoming higher than the hardness on the surface. Further, the material for forming the cured region can be more easily impregnated in the elastic member, and the urethane bond between the isocyanate compound and the hydroxyl group in the elastic member can be more efficiently formed.

In the case where it is necessary to cut the elastic member in order to form the edge for contacting the member to be cleaned on the cleaning blade, the cured region may be formed before or after cutting. In the case of centrifugal molding, it is also possible to form the cured region before being bonded to the supporting member. In this way, a cleaning blade can be obtained.

<Process Cartridge and Electrophotographic Image Forming Apparatus>

The cleaning blade can be embedded into a process cartridge detachably fitted to an electrophotographic image forming apparatus and then can be used. Specifically, for example, in the process cartridge including an image bearing member as the member to be cleaned and a cleaning blade disposed to clean the surface of the image bearing member, the cleaning blade according to this embodiment can be used as this cleaning blade. Such a process cartridge contributes to the stable formation of high-quality electrophotography.

The electrophotographic image forming apparatus according to an embodiment of the present invention includes an image bearing member such as a photosensitive member and a cleaning blade disposed to clean the surface of the image bearing member. This cleaning blade is the cleaning blade according to this embodiment. Such an electrophotographic image forming apparatus is capable of stably forming a high-quality electrophotographic image.

According to one embodiment of the present invention, it is possible to exhibit more excellent cleaning performance in a low-temperature environment, and it is possible to suppress the noise and turnover of the cleaning blade. According to another aspect of the present invention, it is possible to obtain a process cartridge and an electrophotographic image forming apparatus that contribute to the formation of a high-quality electrophotographic image.

EXAMPLES

Hereinafter, the present invention will be described with reference to Preparation Examples, Examples, and Comparative Examples. The present invention is not limited by these examples at all. Reagents or industrial chemicals were used as raw materials other than those indicated in Examples and comparative Examples.

Example 1

In this example, an integral molding type cleaning blade shown in FIGS. 1A and 1B was manufactured and evaluated.

1. Supporting Member

A zinc-coated steel sheet having a thickness of 1.6 mm was prepared, and was processed, so as to obtain a supporting member having an L-shaped section, indicated by reference numeral 3 in FIG. 2. An adhesive (trade name: Chemlock 219, manufactured by Road Corporation) for bonding polyurethane resin was applied to a portion where the supporting member was in contact with the elastic member.

2. Preparation of Raw Material for Elastic Member

Materials of type and amount shown in the column of component 1 in Table 1 were reacted at 80° C. for 3 hours with stirring to obtain a prepolymer having 8.50 mass % of NCO. This prepolymer was mixed with 212.9 g of a curing agent composed of materials of the type and amount shown in the column of component 2 in Table 1 to prepare a polyurethane elastomer composition having a molar ratio (a value) of a hydroxyl group to an isocyanate group of 0.60. This composition was used as a raw material for an elastic member.

TABLE 1

| | Abbreviation | Materials | Used amount (g) |
|---|---|---|---|
| Component 1 | MDI | 4,4-diphenylmethanediisocyanate (trade name; Millionate MTL, manufactured by Tosoh Corporation) | 336.3 |
| | PBA | Polybutylene adipate polyester polyol having number average molecular weight of 2000 | 663.7 |
| Component 2 | PHA | Polyhexylene adipate polyester polyol having number average molecular weight of 1000 | 100.8 |
| | 1-4BD | 1,4-butanediol | 39.1 |
| | TMP | Trimethylolpropane | 72.6 |
| | Catalyst A | Polycat 46 (trade name, manufactured by Air Products and Chemicals Japan Inc.) | 0.04 |
| | Catalyst B | N,N-dimethylaminohexanol (trade name, Kaorizer No. 25, manufactured by Kao Corporation) | 0.38 |

3. Integral Molding of Supporting Member and Elastic Member

The polyurethane elastomer composition was injected into a mold for a cleaning blade in which an adhesive-coated site of the supporting member was disposed to protrude into a cavity, and was cured at 130° C. for 2 minutes, and was then released, so as to obtain an integral molded body of a supporting member and an elastic member. The integral molded body was cut before forming a cured region, the angle of an edge was set to 90°, and the distances of an elastic member in a short direction (lower plane 5), a thickness direction (elevation plane 6) and a longitudinal direction were set to 7.5 mm, 1.8 mm, and 240 mm, respectively.

4. Formation of Cured Region

Modified MDI: carbodiimide-modified MDI (trade name; Millionate MTL, manufactured by Tosoh Corporation) was prepared as a material for forming a cured region. The material for forming a cured region was heated to 70° C., the elastic member of the integral molded body was immersed in this material for 20 seconds such that other five surfaces except for the surface (reference numeral 11 in FIG. 2) of a side facing the supporting member were immersed in this material, and this material was applied on each of the surfaces. The amount of residual isocyanate at the time of coating was 0.8, and the coating was carried out for 1 hour as the elapsed time (hereinafter also referred to as "leaving time") from the completion of the molding of the elastic member to the start of formation of the cured region. Thereafter, the material for forming the cured region on the surface of the elastic member was wiped with a sponge into which butyl acetate was permeated as a solvent. Next, heat treatment was performed in an electric furnace at a temperature of 100° C. for 10 minutes such that the material for forming the cured region impregnated in the elastic member was further diffused into the elastic member and cured. In this way, cleaning blade No. 1 in which the cured region was formed on the five surfaces (first plane, second plane, plane facing the first plane, the both end surfaces in the longitudinal direction) of the elastic member and at the inside below these surfaces was obtained.

The obtained cleaning blade was evaluated by the following method. The results of each evaluation are given in Table 4.

[Evaluation 1] Measurement of Hardness of Cured Region

The hardness in the first plane and the second plane was measured by the method of measuring the hardness of the cured region, and dynamic hardness DHs was obtained. Further, the maximum value DHm of dynamic hardness on the bisector of the edge angle was measured.

[Evaluation 2] Measurement of the Amount of Hydrogen Bonding Derived from a Urethane Group of Cured Region The amount of hydrogen bonding derived from a urethane group in the first plane and the second plane was measured by the method of measuring the amount of hydrogen bonding derived from a urethane group of the cured region, the amount of hydrogen bonding derived from a urethane group of a hardened surface was obtained, and the measured value of the first plane was set as the amount of hydrogen bonding derived from a urethane group. Further, in a section orthogonal to the longitudinal direction of the elastic member, the amount of hydrogen bonding derived from a urethane group in each position where the distance L from the edge on the bisector of the edge angle is $0\ \mu m < L \leq 300\ \mu m$ was measured. Further, the maximum value $M_1$ of the amount of hydrogen bonding derived from a urethane group and the distance L of the position, and the maximum value $M_2$ were obtained, and the value of maximum value $M_1$/maximum value $M_2$ was calculated. In Table 4, the amount of hydrogen bonding derived from a urethane group is simply expressed as "the amount of hydrogen bonding".

[Evaluation 3] Evaluation of Cleaning Performance

Cleaning blade No. 1 was embedded in a black cartridge of a color laser beam printer (trade name; HP LaserJet Enterprise Color M 553 dn, manufactured by Hewlett-Packard Company) as a cleaning blade of a photosensitive drum which is a member to be cleaned. Subsequently, image formation of 15,000 sheets, which is the number of printable sheets, was performed under a low temperature environment (temperature 0° C.) (hereinafter referred to as "normal evaluation"). Further, the developing machine was replaced with a developing machine of a new black cartridge, and image formation of 15,000 sheets, which is the number of printable sheets, was performed again (hereinafter referred to as "double evaluation"). Further, waste toner was evaluated while drawing a hole in the back of the cartridge at appropriate time. Performance of the obtained image was ranked according to the following evaluation criteria.

Rank A: Image defects (streaks on image) due to the cleaning blade do not occur in both the normal evaluation and the double evaluation.

Rank B: Image defects (streaks on image) due to the cleaning blade do not occur in the normal evaluation, and occur slightly in the double evaluation, but there is no problem in practical use.

Rank C: Image defects (streaks on image) due to the cleaning blade do not occur in the normal evaluation, but occur slightly in the double evaluation.

Rank D: Image defects (streaks on image) due to the cleaning blade slightly occur in both the normal evaluation and the double evaluation, but there is no problem in practical use.

Rank E: Image defects (streaks on image) due to the cleaning blade occur in both the normal evaluation and the double evaluation.

[Evaluation 4] Evaluation of Turnover of Cleaning Blade

In the above evaluation of the cleaning performance, although turnover or noise did not occur, as a reference, the turnover evaluation of the cleaning blade under an environment more severe than usual use was carried out as follows.

Separately from the evaluation of cleaning performance, the cleaning blade of this example was embedded into a new black cartridge as a cleaning blade for a photosensitive drum which is a member to be cleaned, and image formation of 15,000 sheets was performed under a low-temperature environment (temperature: 0° C.). Thereafter, the cartridge from which a developing machine was removed was set in an idle rotating machine (an apparatus equipped with a jig holding the cartridge while rotating the photosensitive drum). Under the same environment, idle rotation was performed at a rotation speed of 170 rpm of the photosensitive drum, and the state of the tip portion of the cleaning blade was observed for 10 minutes. This observation was performed by processing a cartridge and installing a CCD camera or the like. Performance of the obtained image was ranked according to the following evaluation criteria.

Rank A: Turnover and noise (chattering noise) do not occur.

Rank B: Turnover does not occur, but noise (chattering noise) slightly occurs.

Rank C: Turnover does not occur, but noise (chattering noise) occurs.

Rank D: Turnover occurs.

[Evaluation 5] Torque Evaluation of Cleaning Blade

In the above evaluation of the cleaning performance, although torque increase did not occur, as a reference, the torque evaluation of the cleaning blade under an environment more severe than usual use was carried out as follows.

Separately from the evaluation of cleaning performance, the cleaning blade of this example was embedded into a new black cartridge as a cleaning blade for a photosensitive drum which is a member to be cleaned, and image formation of 15,000 sheets was performed under a low-temperature environment (temperature: 0° C.). Thereafter, the cleaning blade was taken out, the cleaning blade was mounted on a torque measurement machine, and torque was measured while rotating the photosensitive drum. Performance of the obtained image was ranked according to the following evaluation criteria.

Rank A: Torque does not increase.

Rank B: Torque increase is less than 10%.

Rank C: Torque increase is 10% or more and less than 20%.

Rank D: Torque increase is 20% or more.

Example 2

Cleaning blade No. 2 was obtained in the same manner as in Example 1, except that the immersion plane was set to four planes (contact plane, top plane, and both end planes in the longitudinal direction) in the formation of the cured region.

Examples 3 to 12

Cleaning blades No. 3 to No. 12 were obtained in the same manner as in Example 1, except that the temperature of material for forming a cured region, immersion time, the temperature of an electric furnace, heat treatment time, the amount of residual isocyanate and leaving time in the formation of the cured region were changed into the conditions given in Table 2.

Example 13

An integral molded body of a supporting member and an elastic member was manufactured in the same manner as in Example 1. Next, before forming a cured region, this elastic member was cut such that the short direction of the elastic member was a predetermined dimension. Next, a cured region was formed by changing cured region forming conditions into the conditions given in Table 3 using the same material for forming a cured region as that of Example 1. Specifically, the material for forming the cured region was heated to a temperature of 80° C., and was applied onto the elevation plane (second plane) of the elastic member using a dispenser. At this time, the amount of residual isocyanate was 0.8, and leaving time was 1 hour. This integral molded body was left for 10 minutes under an environment of a temperature of 25° C. and a relative humidity of 50%, and then heat-treated in an electric furnace at a temperature of 100° C. for 10 minutes. Next, cooling was performed, and the elastic member was cut such that the distance in the longitudinal direction was 240 mm, so as to obtain cleaning blade No. 13. The formation of the cured region is one plane of only the elevation plane (second plane) of the elastic member.

Comparative Example 1

This comparative example is an example in which a cured region is not formed in an elastic member. An integral molded body of a supporting member and an elastic member was manufactured in the same manner as in Example 1. Next, the integral molded body member was cut such that the short direction of this elastic member was 7.5 mm and the longitudinal direction thereof was 240 mm, so as to obtain cleaning blade No. H1.

Comparative Examples 2 to 6

Cleaning blades No. H2 to No. H6 were obtained in the same manner as in Example 1, except that the temperature of material for forming a cured region, immersion time, the temperature of an electric furnace, heat treatment time, the amount of residual isocyanate and leaving time in the formation of the cured region were changed into the conditions given in Table 2.

The evaluation results of Examples 1 to 13 and Comparative Examples 1 to 6 are given in Table 4.

TABLE 2

| | | Examples | | | | | | | | |
|---|---|---|---|---|---|---|---|---|---|---|
| | | 1 | 2 | 3 | 4 | 5 | 6 | 7 | 8 | 9 |
| Cleaning blade No. | | 1 | 2 | 3 | 4 | 5 | 6 | 7 | 8 | 9 |
| The number of cured planes of elastic member | | 5 planes | 4 planes | 5 planes | 5 planes | 5 planes | 5 planes | 5 planes | 5 planes | 5 planes |
| Amount of residual isocyanate (absorbance ratio A/B) | | 0.8 | 0.8 | 0.9 | 0.8 | 0.8 | 0.5 | 0.8 | 0.8 | 0.5 |
| Time from elastic member formation to cured region formation | hour | 1 | 1 | 0.5 | 1 | 1 | 3 | 1 | 1 | 3 |
| Temperature of material for forming cured region | ° C. | 70 | 70 | 60 | 60 | 60 | 70 | 70 | 70 | 70 |
| Immersion time | second | 20 | 20 | 30 | 10 | 20 | 10 | 10 | 30 | 10 |
| Temperature of electric furnace | ° C. | 100 | 100 | 90 | 90 | 90 | 110 | 100 | 90 | 90 |
| Heat treatment time | minute | 10 | 10 | 10 | 10 | 30 | 30 | 30 | 10 | 10 |

TABLE 2-continued

| | | Examples | | | Comparative Examples | | | | | |
|---|---|---|---|---|---|---|---|---|---|---|
| | | 10 | 11 | 12 | 1 | 2 | 3 | 4 | 5 | 6 |
| Cleaning blade No. | | 10 | 11 | 12 | H1 | H2 | H3 | H4 | H5 | H6 |
| The number of cured planes of elastic member | | 5 planes | 5 planes | 5 planes | 0 | 5 planes | 5 planes | 5 planes | 5 planes | 5 planes |
| Amount of residual isocyanate (absorbance ratio A/B) | | 0.5 | 0.5 | 0.5 | — | 0.8 | 0.8 | 0.2 | 0.2 | 0.9 |
| Time from elastic member formation to cured region formation | hour | 3 | 3 | 3 | — | 1 | 1 | 6 | 6 | 0.5 |
| Temperature of material for forming cured region | ° C. | 60 | 60 | 60 | — | 90 | 80 | 60 | 60 | 80 |
| Immersion time | second | 10 | 10 | 10 | — | 10 | 40 | 10 | 10 | 20 |
| Temperature of electric furnace | ° C. | 110 | 100 | 90 | — | 130 | 90 | 130 | 80 | — |
| Heat treatment time | minute | 30 | 30 | 30 | — | 30 | 10 | 10 | 10 | — |

TABLE 3

| Example | 13 |
|---|---|
| Cleaning blade No. | 13 |
| The number of cured planes of elastic member | One plane of only second plane |
| Coating method | Dispenser coating |
| Amount of residual isocyanate (absorbance ratio A/B) | 0.8 |

TABLE 3-continued

| Example | | 13 |
|---|---|---|
| Time from elastic member formation to cured region formation | hour | 1 |
| Temperature of material for forming cured region | ° C. | 80 |
| Temperature of electric furnace | ° C. | 100 |
| Heat treatment time | minute | 10 |

TABLE 4

| | Examples | | | | | | | | | |
|---|---|---|---|---|---|---|---|---|---|---|
| | 1 | 2 | 3 | 4 | 5 | 6 | 7 | 8 | 9 | 10 |
| Cleaning blade No. | 1 | 2 | 3 | 4 | 5 | 6 | 7 | 8 | 9 | 10 |
| Dynamic hardness of surface DHs | 0.20 | 0.20 | 0.15 | 0.25 | 0.35 | 0.18 | 0.20 | 0.40 | 0.10 | 0.14 |
| Dynamic hardness of inner part DHm | 0.20 | 0.18 | 0.13 | 0.24 | 0.30 | 0.16 | 0.17 | 0.36 | 0.08 | 0.12 |
| $I_{bs}/I_{fs}$ | 0.80 | 0.78 | 1.00 | 0.80 | 0.85 | 0.70 | 0.75 | 0.90 | 0.72 | 0.70 |
| $M_1$ | 0.95 | 0.90 | 1.20 | 0.92 | 1.00 | 0.77 | 0.87 | 1.05 | 0.83 | 0.81 |
| Distance from edge at position indicated by $M_1$ on straight line (μm) | 50 | 50 | 50 | 20 | 100 | 50 | 50 | 100 | 50 | 150 |
| $M_1/(I_{bs}/I_{fs})$ | 1.19 | 1.15 | 1.20 | 1.15 | 1.18 | 1.10 | 1.16 | 1.17 | 1.15 | 1.16 |
| $M_1/M_2$ | 1.24 | 1.20 | 1.26 | 1.20 | 1.23 | 1.15 | 1.10 | 1.23 | 1.18 | 1.18 |
| Treated plane in image forming region | 3 planes | 2 planes | 3 planes | 3 planes | 3 planes | 3 planes | 3 planes | 3 planes | 3 planes | 3 planes |
| Torque evaluation | A | A | A | A | A | A | A | B | B | B |
| Turnover (noise) evaluation | A | A | B | B | B | B | B | A | A | B |
| Cleaning performance | A | A | A | B | B | B | B | B | B | C |

| | Examples | | | Comparative Examples | | | | | |
|---|---|---|---|---|---|---|---|---|---|
| | 11 | 12 | 13 | 1 | 2 | 3 | 4 | 5 | 6 |
| Cleaning blade No. | 11 | 12 | 13 | H1 | H2 | H3 | H4 | H5 | H6 |
| Dynamic hardness of surface DHs | 0.13 | 0.12 | 0.11 | 0.07 | 0.13 | 0.50 | 0.09 | 0.13 | 0.60 |
| Dynamic hardness of inner part DHm | 0.11 | 0.10 | 0.10 | 0.07 | 0.16 | 0.45 | 0.07 | 0.11 | 0.45 |

TABLE 4-continued

| | | | | | | | | | |
|---|---|---|---|---|---|---|---|---|---|
| $I_{bs}/I_{fs}$ | 0.70 | 0.67 | 0.70 | 0.75 | 0.78 | 0.80 | 0.70 | 0.80 | 1.10 |
| $M_1$ | 0.75 | 0.72 | 0.75 | 0.77 | 0.90 | 0.95 | 0.73 | 0.78 | 0.85 |
| Distance from edge at position indicated by $M_1$ on straight line (μm) | 150 | 150 | 150 | 50 | 50 | 100 | 50 | 20 | 20 |
| $M_1/(I_{bs}/I_{fs})$ | 1.07 | 1.07 | 1.07 | 1.03 | 1.15 | 1.19 | 1.04 | 0.98 | 0.77 |
| $M_1/M_2$ | 1.15 | 1.07 | 1.07 | 1.00 | 1.18 | 1.18 | 1.00 | 1.20 | 1.13 |
| Treated plane in image forming region | 3 planes | 3 planes | 1 planes | — | 3 planes | 3 planes | 3 planes | 3 planes | 3 planes |
| Torque evaluation | B | C | C | D | D | D | D | C | D |
| Turnover (noise) evaluation | C | C | C | D | A | A | D | D | D |
| Cleaning performance | C | C | D | E | B | E | E | E | E |

In each of the cleaning blades of Examples 1 to 13, the dynamic hardness DHs of the surface of the cured region satisfies the condition of Formula (1), the maximum value DHm of the dynamic hardness inside a free end satisfies the condition of Formula (2), the amount of hydrogen bonding derived from a urethane group on the hardened surface is controlled, and the amount of hydrogen bonding derived from a urethane group inside the free end is larger than the amount of hydrogen bonding derived from a urethane group on the surface. As a result, followability to the member to be cleaned in a low-temperature environment is secured, torque increases, the noise and turnover of a blade is suppressed, and thus cleaning performance is maintained even after long-term use. Among them, the results of Examples 1 and 2 were better.

In the cleaning blades of Examples 1 to 12, since the cured region is formed on both sides of the first plane and the second plane forming the edge to be brought into contact with the member to be cleaned of the elastic member, the behavior of the tip portion during cleaning was stabilized, and better cleaning properties was obtained.

In Examples 1 to 11, since the maximum value $M_1$ of the amount of hydrogen bonding derived from a urethane group of inner part 1 is 1.10 times or more larger than the maximum value $M_2$ of the amount of hydrogen bonding derived from a urethane group of inner part 2, better cleaning properties was obtained even in long-term use in a low temperature environment.

In Examples 1 to 10, since the maximum value $M_1$ of the amount of hydrogen bonding derived from a urethane group of inner part 1 is 1.10 times or more larger than the amount of hydrogen bonding derived from a urethane group on the hardened surface, the contact pressure to the member to be cleaned can be more reliably applied, the followability of the member to be cleaned is secured even under long-term use in a low-temperature environment, the noise and turnover of the cleaning blade hardly occur, and good cleaning properties are obtained.

In Examples 1 to 9, since the distance L at the position indicating the maximum value of the amount of hydrogen bonding derived from a urethane group of inner part 1 is within the range of 20 μm or more and 100 μm or less from the edge on the bisector of the edge angle, the noise and turnover of the cleaning blade can be further reduced in a low temperature environment, and the cleaning performance can be maintained even after long-term use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-213369, filed Oct. 31, 2016, which is hereby incorporated by reference herein in its entirety.

What is claimed is:

1. A cleaning blade, comprising:

an elastic member containing urethane rubber; and a supporting member supporting the elastic member, wherein a free end of the elastic member has:

an edge; and a first plane and a second plane constituting the edge, either or both of the first plane and the second plane have a hardened surface, wherein, the cleaning blade satisfies the following relationships represented by Formula (1) and Formula (2):

$$0.10 \leq DHs \leq 0.40 \quad (1)$$

$$DHs \geq DHm \quad (2)$$

where

DHs ($mN/\mu m^2$) represents a dynamic hardness of the hardened surface; and

DHm ($mN/\mu m^2$) represents a maximum value of a dynamic hardness obtained in a positional range in which a distance L from the edge on a straight line that bisects an angle of the edge in a cross-section of the elastic member orthogonal to a longitudinal direction of the elastic member satisfies 0 μm<L≤200 μm, wherein, the elastic member satisfies a peak intensity ratio $I_{bs}/I_{fs}$ of 1.0 or less, wherein $I_{bs}$ represents a peak intensity of ν C═O bond (1708 to 1720 $cm^{-1}$) derived from a urethane group hydrogen bond and $I_{fs}$ is a peak intensity of ν C═O free (1724 to 1736 $cm^{-1}$) derived from a urethane group in urethane rubber in an IR chart obtained at the hardened surface with AFM-IR, and wherein, when M1 is defined as a maximum value of a peak intensity ratio of $I_{b1}/I_{f1}$ in a positional range in which a distance L from the edge on the straight line satisfies 0 μm<L≤200 μm, where $I_{b1}$ is a peak intensity of ν C═O bond (1708 to 1720 $cm^{-1}$) derived from a urethane group hydrogen bond and $I_{f1}$ is a peak intensity of ν C═O free (1724 to 1736 $cm^{-1}$) derived from a urethane group in urethane rubber in IR charts obtained at each positons in the positional range with AFM-IR, the maximum vale M1 is greater than the peak intensity ratio $I_{bs}/I_{fs}$.

2. The cleaning blade according to claim 1, wherein the position indicating the maximum value $M_1$ is at a distance L of 20 μm or more and 100 μm or less from the edge on the straight line.

3. The cleaning blade according to claim 1, wherein the maximum value $M_1$ is 1.10 times or more the peak intensity ratio $I_{bs}/I_{fs}$.

4. The cleaning blade according to claim 1, wherein, when, M2 is defined as a maximum value of a peak intensity ratio $I_{b2}/I_{f2}$ at each position where the distance L from the edge on the straight line is more than 200 μm, where $I_{b2}$ is a peak intensity of ν C═O bond (1708 to 1720 $cm^{-1}$) derived from a urethane group hydrogen bond and $I_{f2}$ is a peak intensity of ν C═O free (1724 to 1736 $cm^{-1}$) derived from a urethane group in urethane rubber in IR charts obtained at the each positions with AFM-IR, the maximum value $M_1$ is 1.10 times or more the maximum value $M_2$.

5. The cleaning blade according to claim 1, wherein the hardened surface exists on both the first plane and the second plane.

6. The cleaning blade according to claim 1, wherein both end faces of the elastic member in a longitudinal direction have a hardened surface.

7. A process cartridge, which is detachably configured in an electrophotographic image forming apparatus, comprising:

an image bearing member; and a cleaning blade disposed to clean a surface of the image bearing member, wherein the cleaning blade comprises an elastic member containing urethane rubber and a supporting member supporting the elastic member, a free end of the elastic member has:

an edge; and a first plane and a second plane constituting the edge, either or both of the first plane and the second plane have a hardened surface, wherein, the cleaning blade satisfies the following relationships represented by Formula (1) and Formula (2):

$$0.10 \leq DHs \leq 0.40 \quad (1)$$

$$DHs \geq DHm \quad (2)$$

where

DHs ($mN/\mu m^2$) represents a dynamic hardness of the hardened surface; and

DHm ($mN/\mu m^2$) represents a maximum value of a dynamic hardness obtained in a positional range in which a distance L from the edge on a straight line that bisects an angle of the edge in a cross-section of the elastic member orthogonal to a longitudinal direction of the elastic member satisfies 0 μm<L≤200 μm, wherein, the elastic member satisfies a peak intensity ratio $I_{bs}/I_{fs}$ of 1.0 or less, wherein $I_{bs}$ represents a peak intensity of ν C═O bond (1708 to 1720 $cm^{-1}$) derived from a urethane group hydrogen bond and $I_{fs}$ is a peak intensity of ν C═O free (1724 to 1736 $cm^{-1}$) derived from a urethane group in urethane rubber in an IR chart obtained at the hardened surface with AFM-IR, and wherein, when M1 is defined as a maximum value of a peak intensity ratio $I_{b1}/I_{f1}$ of in a positional range in which a distance L from the edge on the straight line satisfies 0 μm<L≤200 μm, where $I_{b1}$ is a peak intensity of ν C═O bond (1708 to 1720 $cm^{-1}$) derived from a urethane group hydrogen bond and $I_{f1}$ is a peak intensity of ν C═O free (1724 to 1736 $cm^{-1}$) derived from a urethane group in urethane rubber in IR charts obtained at each positions in the positional range with AFM-IR, the maximum value M1 is greater than the peak intensity ratio $I_{bs}/I_{fs}$.

8. An electrophotographic image forming apparatus, comprising:

an image bearing member; and a cleaning blade disposed to clean a surface of the image bearing member, wherein the cleaning blade comprises an elastic member containing urethane rubber and a supporting member supporting the elastic member, a free end of the elastic member has:

an edge and a first plane and a second plane constituting the edge, either or both of the first plane and the second plane have a hardened surface, wherein, the cleaning blade satisfies the following relationships represented by Formula (1) and Formula (2):

$$0.10 \leq DHs \leq 0.40 \quad (1)$$

$$DHs \geq DHm \quad (2)$$

where

DHs ($mN/\mu m^2$) represents a dynamic hardness of the hardened surface; and

DHm ($mN/\mu m^2$) represents a maximum value of a dynamic hardness obtained in a positional range in which a distance L from the edge on a straight line that bisects an angle of the edge in a cross-section of the elastic member orthogonal to a longitudinal direction of the elastic member satisfies 0 μm<L≤200 μm, wherein, the elastic member satisfies a peak intensity ratio $I_{bs}/I_{fs}$ of 1.0 or less, wherein $I_{bs}$ represents a peak intensity of ν C═O bond (1708 to 1720 $cm^{-1}$) derived from a urethane group hydrogen bond and $I_{fs}$ is a peak intensity of ν C═O free (1724 to 1736 $cm^{-1}$) derived from a urethane group in urethane rubber in an IR chart obtained at the hardened surface with AFM-IR, and wherein, when M1 is defined as a maximum value of a peak intensity ratio $I_{b1}/I_{f1}$ of in a positional range in which a distance L from the edge on the straight line satisfies 0 μm<L≤200 μm, where $I_{b1}$ is a peak intensity of ν C═O bond (1708 to 1720 $cm^{-1}$) derived from a urethane group hydrogen bond $I_{f1}$ is a peak intensity of ν C═O free (1724 to 1736 $cm^{-1}$) derived from a urethane group in urethane rubber in IR charts obtained at each positions in the positional range with AFM-IR, the maximum value M1 is greater than the peak intensity ratio $I_{bs}/I_{fs}$.

* * * * *